US006955531B2

(12) United States Patent
Wu

(10) Patent No.: US 6,955,531 B2
(45) Date of Patent: Oct. 18, 2005

(54) PUMP FOR INFLATING AND DEFLATING AN INFLATABLE OBJECT WITH A ROTATABLE NOZZLE ASSEMBLY

(76) Inventor: Scott Wu, No. 6, Lane 176, Wu Fu Road, Wu Feng Hsiang, Taichung Hsien (TW)

( * ) Notice: Subject to any disclaimer, the term of this patent is extended or adjusted under 35 U.S.C. 154(b) by 273 days.

(21) Appl. No.: 10/396,232

(22) Filed: Mar. 24, 2003

(65) Prior Publication Data

US 2004/0191098 A1 Sep. 30, 2004

(51) Int. Cl.[7] ..... F04B 39/10

(52) U.S. Cl. ..... 417/571; 417/460; 417/469; 417/569; 137/231; 141/37; 141/38

(58) Field of Search ..... 417/460, 469, 417/499, 506, 569, 571; 137/231; 280/201; 141/37, 38, 65, 67

(56) References Cited

U.S. PATENT DOCUMENTS 3,095,825 A * 7/1963 Sandberg et al. ..... 92/15
3,319,879 A * 5/1967 Brown ..... 417/571
3,803,988 A * 4/1974 Orr ..... 92/85 R
4,515,530 A * 5/1985 Christoleit ..... 417/214
4,776,776 A * 10/1988 Jones ..... 417/560
5,032,066 A * 7/1991 Baty ..... 417/499
5,156,538 A * 10/1992 Lee ..... 417/571
5,213,125 A * 5/1993 Leu ..... 137/15.18
6,164,938 A * 12/2000 Chuang ..... 417/569
6,168,400 B1 * 1/2001 Van Davelaar et al. ..... 417/571
6,200,113 B1 * 3/2001 Van Davelaar ..... 417/571
6,345,958 B1 * 2/2002 Chen ..... 417/63

* cited by examiner

*Primary Examiner*—Charles G. Freay
*Assistant Examiner*—Emmanuel Sayoc
(74) *Attorney, Agent, or Firm*—Alan D. Kamrath; Nikolai & Mersereau, P.A.

(57) ABSTRACT

A pump is capable of inflating and deflating an inflatable object. The pump includes a cylinder, a piston and a nozzle. The cylinder defines an outlet through which air can only flow into the cylinder and an inlet through which air can only flow from the cylinder. The piston reciprocates in the cylinder. The nozzle defines a first hole for communication with the inflatable object and a second hole for communication with the exterior. The nozzle is rotationally mounted on the cylinder between an inflating mode and a deflating mode. In the inflating mode, the first hole is communicated with the outlet, and the second hole with the inlet. In the deflating mode, the first hole is communicated with the inlet, and the second hole with the outlet.

20 Claims, 16 Drawing Sheets

PUMP FOR INFLATING AND DEFLATING AN INFLATABLE OBJECT WITH A ROTATABLE NOZZLE ASSEMBLY

BACKGROUND OF INVENTION

1. Field of Invention

The present invention relates to a pump for inflating and deflating.

2. Related Prior Art

U.S. Pat. No. 6,422,832 discloses an air pump capable of inflating and deflating an inflatable object interchangeably. This air pump includes a main body or cylinder 10 defining a duct 11, a base 21, an air-discharging tube 23, an air-admitting tube 24, an adjustment member 40 and a hose 50. The cylinder 10 defines four holes 15~18 communicated with the duct 11. The base 21 includes a first connecting port 211, a second connecting port 212, a first manifold 214 communicated with the first connecting port 211 and a second manifold 215 communicated with the second connecting port 212. Through the hole 15, the cylinder 10 is communicated with the first connecting port 211. In the hole 15 is installed a check valve 25 for directing air from the cylinder 10 to the base 21 only. The first manifold 214 is communicated with a lower end of the air-discharging tube 23. Through the hole 17, the cylinder 10 is communicated with an upper end of the air-discharging tube 23. In the hole 17 is installed a check valve 27 for directing air from the cylinder 10 to the air-discharging tube 23 only. Through the hole 16, the cylinder 10 is communicated with the second connecting port 212. In the hole 16 is installed a check valve 26 for directing air from the base 21 to the cylinder 10 only. Through the hole 18, the cylinder 10 is communicated with an upper end of the air-admitting tube 24. In the hole 18 is installed a check valve 28 for directing air from the air-admitting tube 24 to the cylinder 10 only. The adjustment member 40 is rotationally mounted on the base 21. The adjustment member 40 defines a first opening 41 and a second opening 42 communicated with the first opening 41. The first opening 41 of the adjustment member 40 is selectively communicated with the first connecting port 211 or the second connecting port 212. The second opening 42 of the adjustment member 40 is communicated with the hose 50. Referring to FIGS. 2, 4 and 5 of U.S. Pat. No. 6,422,832, the openings 41 and 42 of the adjustment member 40 are communicated with the first connecting port 211 of the base 20. Referring to FIG. 4 of U.S. Pat. No. 6,422,832, when a piston 31 is moved downward in the cylinder 10, air is pumped from the cylinder 10 to the hose 20 through the hole 15 of the cylinder 10 and the first connecting port 211 of the base 21. Referring to FIG. 5 of U.S. Pat. No. 6,422,832, as the piston 31 is moved upward in the cylinder 10, air is pumped from the cylinder 10 to the hose 20 through the hole 15 of the cylinder 10 and the first connecting port 211 of the base 21. Referring to FIGS. 6~8 of U.S. Pat. No. 6,422,832, the openings 41 and 42 of the adjustment member 40 are communicated with the second connecting port 212 of the base 20. Referring to FIG. 7 of U.S. Pat. No. 6,422,832, as the piston 31 is moved downward in the cylinder 10, air is sucked from the hose 20 to the cylinder 10 through the second connecting port 212 of the base 21 and the hole 18 of the cylinder 10. Referring to FIG. 8 of U.S. Pat. No. 6,422,832, as the piston 31 is moved upward in the cylinder 10, air is sucked from the hose 20 to the cylinder 10 through the hole 16 of the cylinder 10 and the second connecting port 212 of the base 21. However, the inclusion of the tubes 23 and 24 increases the volume of the pump. The inclusion of the four check valves 25~28 increases the cost of the pump. The rotation of the adjustment member 40 on the base 21 interferes with installment of the pump in a limited space. The angular position of the adjustment member 40 on the base 21 cannot be locked, and unintentional rotation of the adjustment member 40 on the base 21 hinders the operation of the pump.

The present invention is therefore intended to obviate or at least alleviate the problems encountered in the prior art.

SUMMARY OF INVENTION

It is an objective of the present invention to provide a compact pump capable of inflating and deflating an inflatable object.

It is another objective of the present invention to provide an inexpensive pump capable of inflating and deflating an inflatable object.

It is still another objective of the present invention to provide a pump that can be held in an inflating mode or a deflating mode.

According to the present invention, a pump includes a cylinder, a piston and a nozzle. The cylinder defines an outlet through which air can only flow into the cylinder and an inlet through which air can only flow from the cylinder. The piston reciprocates in the cylinder. The nozzle defines a first hole for communication with the inflatable object and a second hole for communication with the exterior. The nozzle is rotationally mounted on the cylinder between an inflating mode and a deflating mode. In the inflating mode, the first hole is communicated with the outlet, and the second hole is communicated with the inlet. In the deflating mode, the first hole is communicated with the inlet, and the second hole is communicated with the outlet.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF EMBODIMENTS

Figure 1:
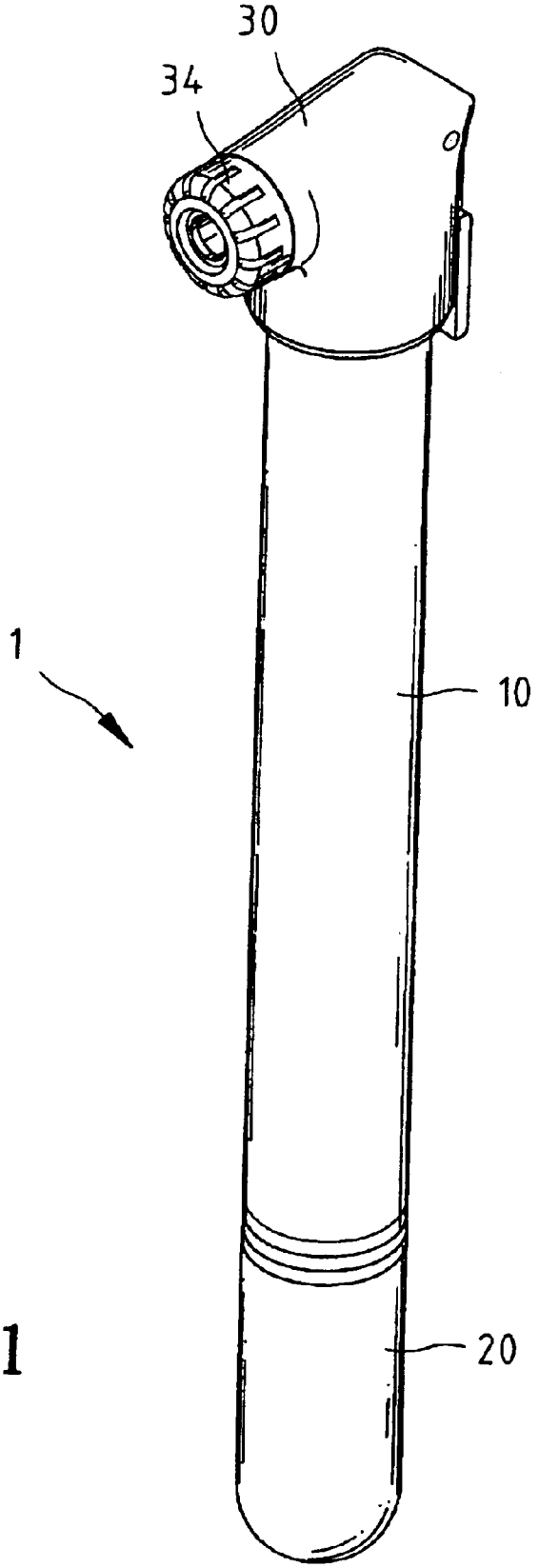
FIG. 1 is a perspective view of a pump for inflating and deflating according to a first embodiment of the present invention.

FIG. 1 shows a pump 1 for inflating and deflating according to a first embodiment of the present invention.

Figure 2:
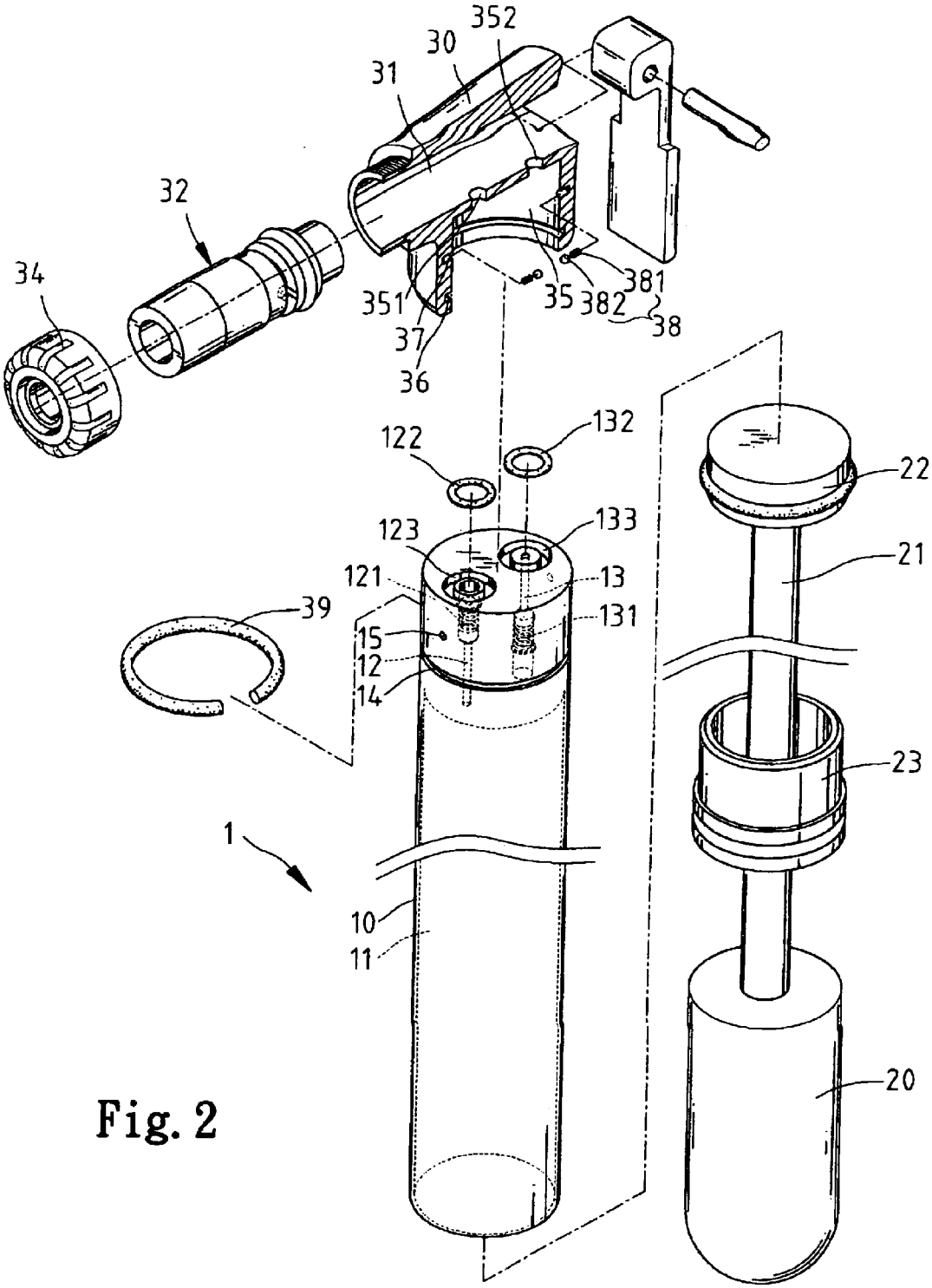
FIG. 2 is an exploded view of the pump shown in FIG. 1.
Figure 3:
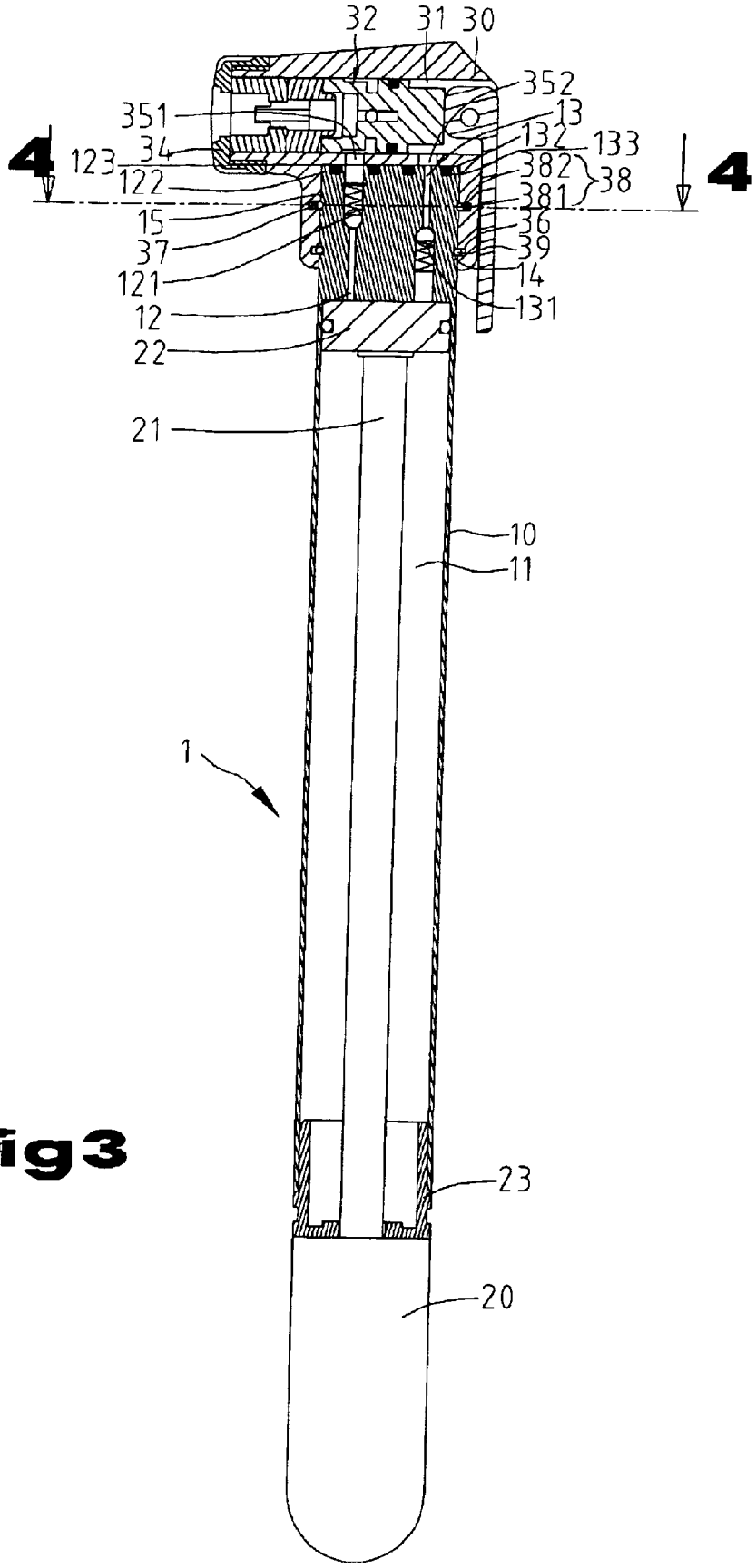
FIG. 3 is a cross-sectional view taken along a line 3—3 in FIG. 4.
Figure 4:
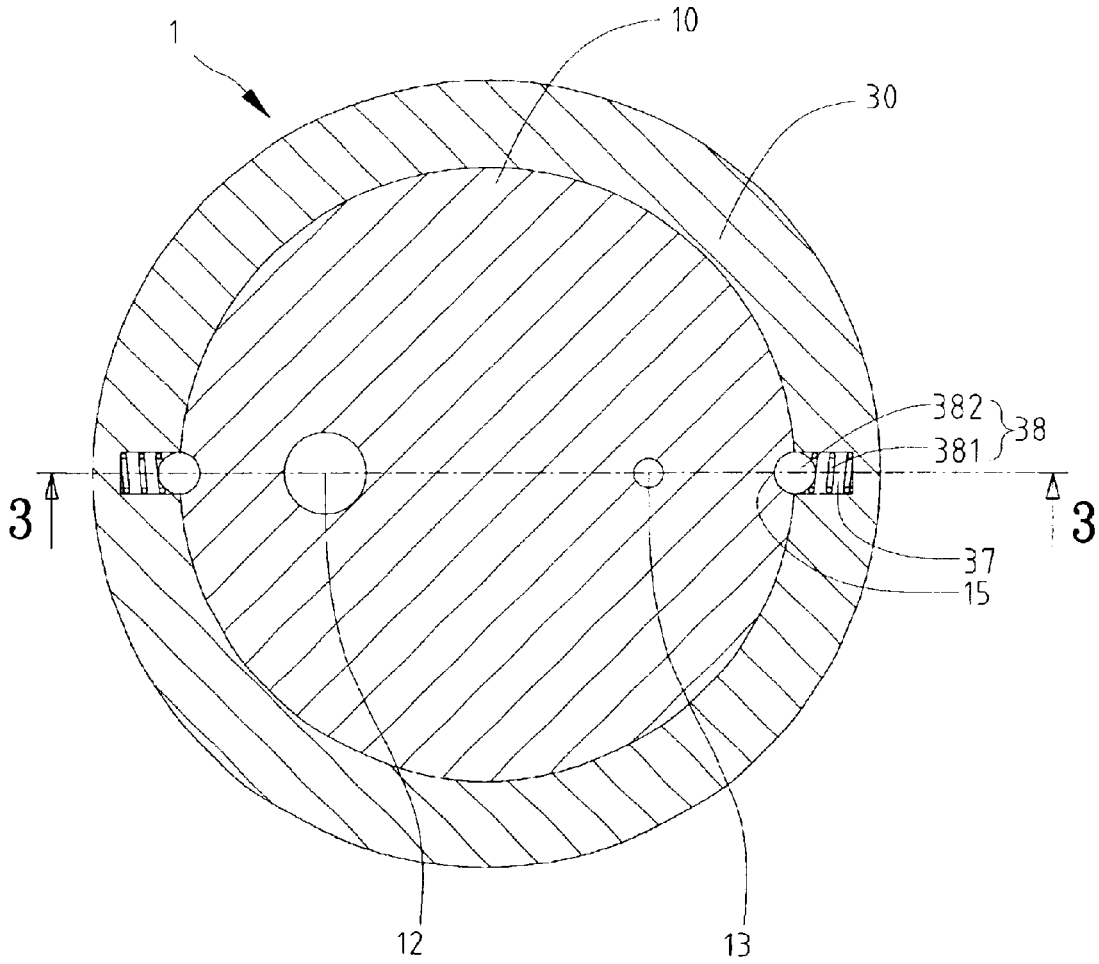
FIG. 4 is a cross-sectional view taken along a line 4—4 in FIG. 3.

Referring to FIGS. 2~4, the pump 1 includes a cylinder 10, a piston 22 in the cylinder 10 and a nozzle 30 communicated with the cylinder 10.

The cylinder 10 includes an open end and a semi-closed end, and defines a space 11 extending from the open end to the semi-closed end, thus forming an internal face and an external face.

A connecting rod 21 includes a first end connected with the piston 22 and a second end connected with a handle 20 for reciprocating the piston 22 in the cylinder 10. At the open end of the cylinder 10, a ring 23 is located between the cylinder 10 and the connecting rod 21. The ring 23 includes an external face engaged with the internal face of the cylinder 10, thus retaining the piston 22 in the cylinder 10.

An outlet 12 is defined in the semi-closed end of the cylinder 10, and so is an inlet 13. The term "outlet" indicates air flowing from the space 11. The term "inlet" indicates air flowing into the space 11. A check valve 121 is installed in the outlet 12. A check valve 131 is installed in the inlet 13. A seal 122 is put in a groove 123 extending around the outlet 12. A seal 132 is put in a groove 133 extending around the inlet 13. A groove 14 extends around the external face of the cylinder 10. Two recesses 15 are defined in the external face of the cylinder 10.

The nozzle 30 defines a first chamber 35 and a second chamber 31 communicated with the first chamber 35 through two holes 351 and 352. A groove 36 is defined in the wall of the first chamber 35. Two recesses 37 are defined in the wall of the first chamber 35. A retaining device 38 is put in each of the recesses 37. Each of the retaining devices 38 includes a spring 381 and a ball detent 382.

A C-ring 39 includes an internal edge put in the groove 14 of the cylinder 10 and an external edge put in the groove 36 of the nozzle 30, thus retaining the nozzle 30 on the cylinder 10. Each of the ball detents 382 partially enters one of the holes 15 when the hole 351 is communicated with the outlet 12, and the hole 352 with the inlet 13.

A mouth 32 is put in the second chamber 31 of the nozzle 30. Different mouths may be used in different applications. A ring 34 is engaged with the nozzle 30, thus retaining the mouth 32 in the second chamber 31 of the nozzle 30.

Figure 5:
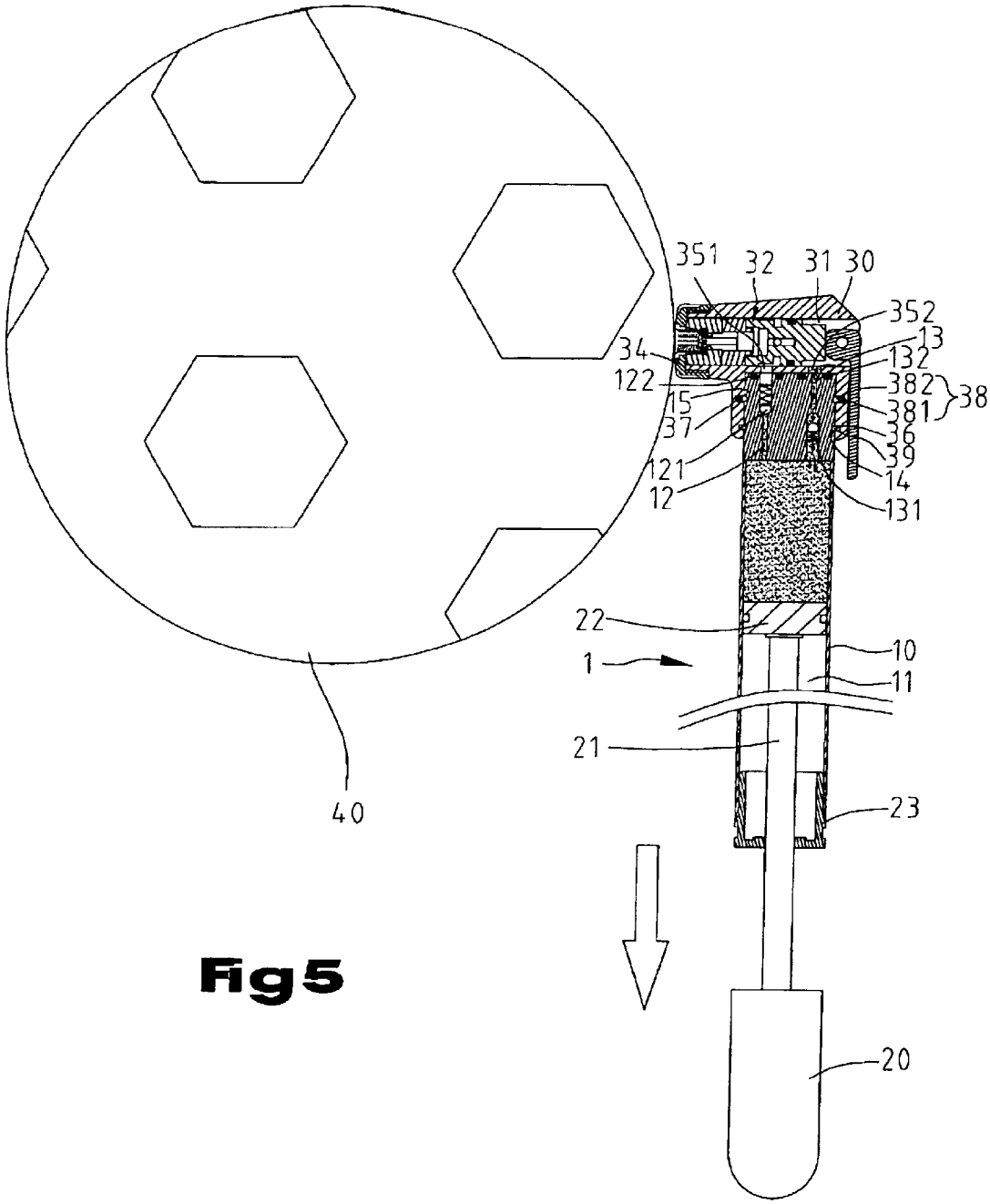
FIG. 5 shows air pumped into a cylinder of the pump shown in FIG. 3 from the exterior.

Referring to FIG. 5, the nozzle 30 is communicated with a ball 40. The piston 22 is moved from the nozzle 30. Air flows from the exterior into the space 11 through the inlet 13, past the check valve 131. Air cannot flow from the ball 40 into the space 11 through the outlet 12 because of the check valve 121.

Figure 6:
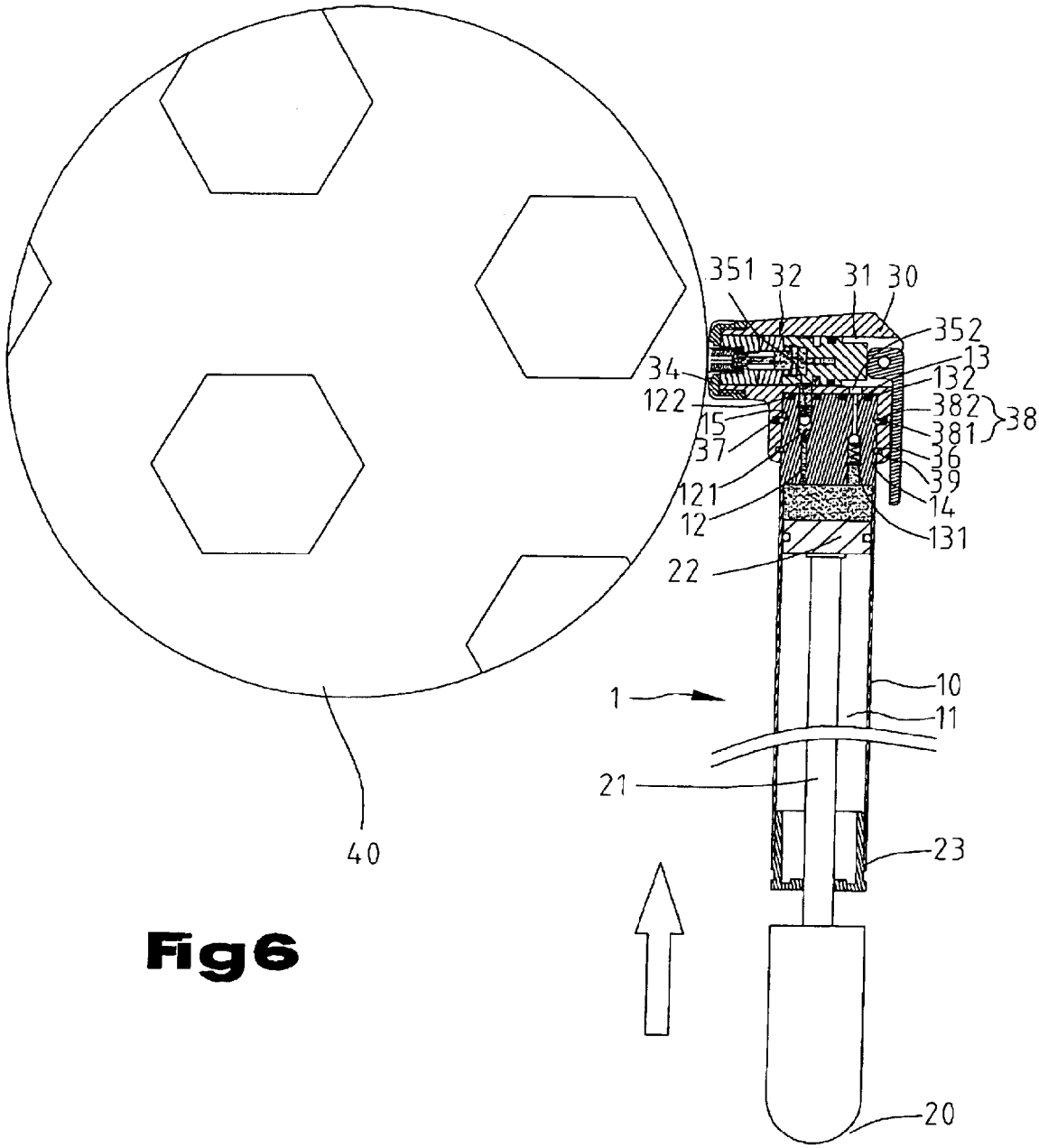
FIG. 6 is similar to FIG. 5, but showing air pumped into a ball from the cylinder.

Referring to FIG. 6, the piston 22 is moved toward the nozzle 30. Air flows from the space 11 into the ball 40 through the outlet 12, past the check valve 121. Air cannot flow from the space 11 into the exterior through the inlet 13 because of the check valve 131.

Figure 7:
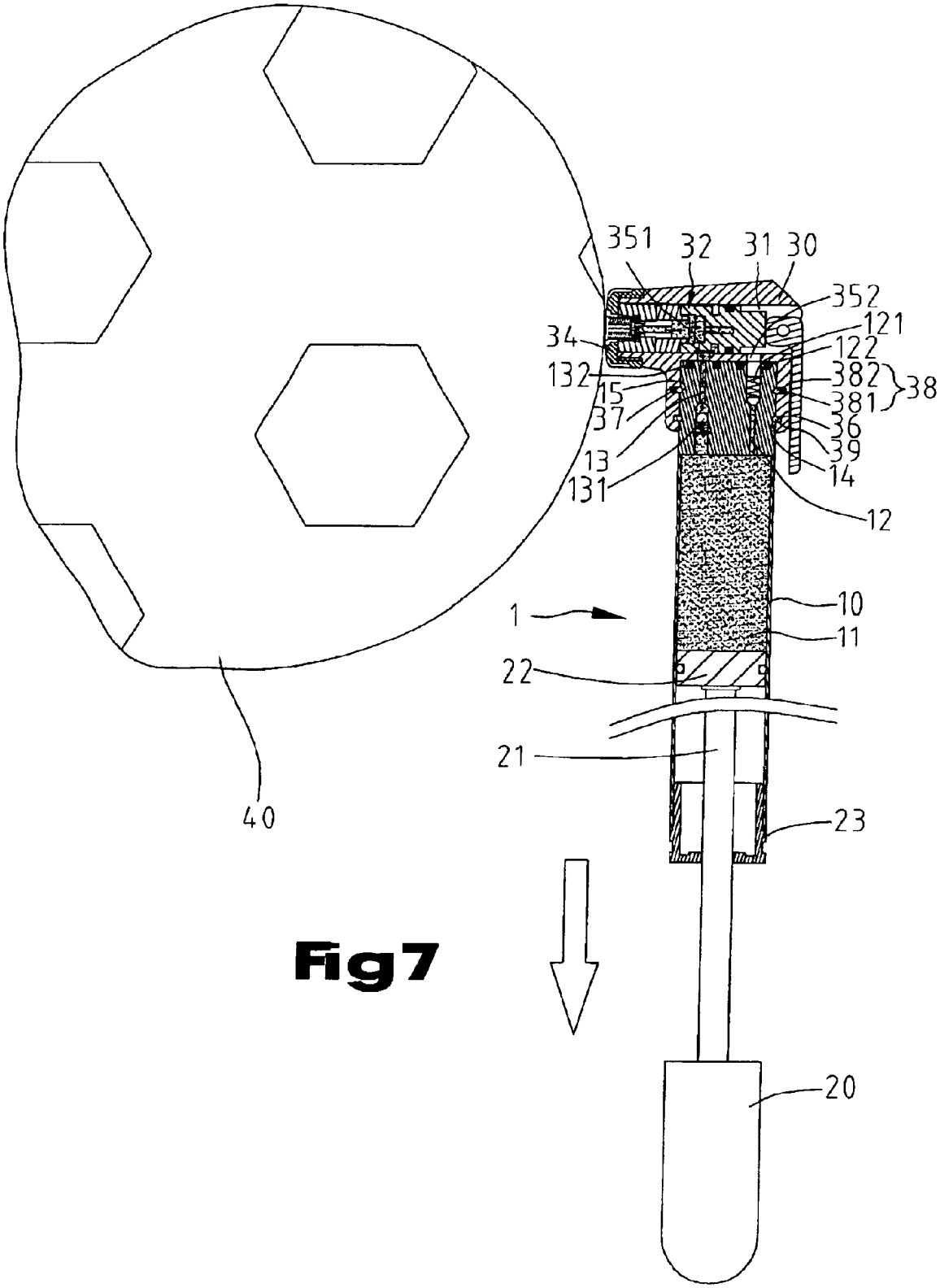
FIG. 7 is similar to FIG. 6, but showing air pumped into the cylinder from the ball.

The cylinder 10 can be rotated relative to the nozzle 30 from the position shown in FIGS. 5 and 6 to a position shown in FIG. 7.

Referring to FIG. 7, the inlet 13 is communicated with the hole 351, and the outlet 12 with the hole 352. The piston 22 is moved from the nozzle 30. Air flows from the ball 40 into the space 11 through the inlet 13, past the check valve 131. Air cannot flow from the exterior into the space 11 through the outlet 12 because of the check valve 121.

Figure 8:
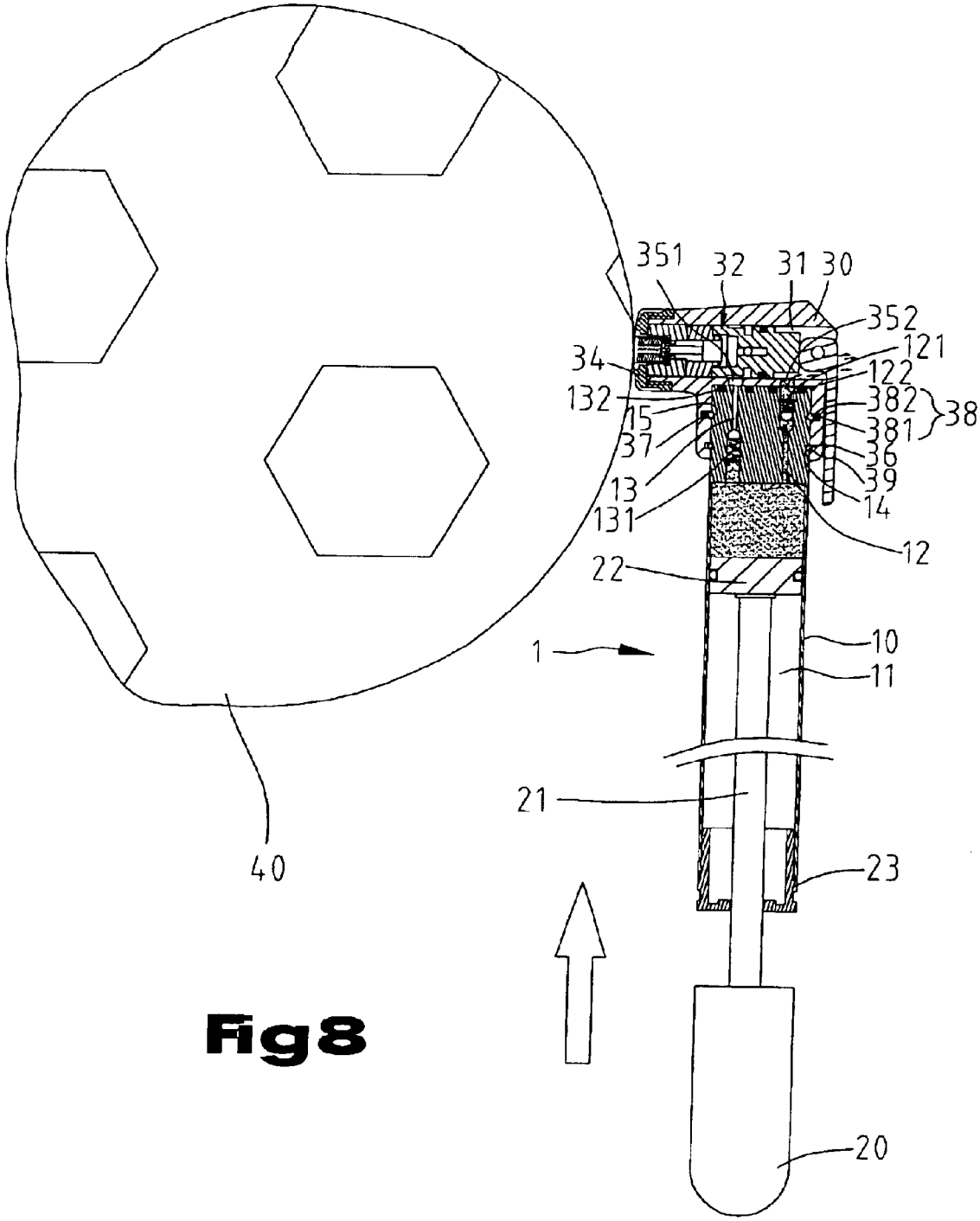
FIG. 8 is similar to FIG. 7, but showing air discharged to the exterior from the cylinder.
Figure 10:
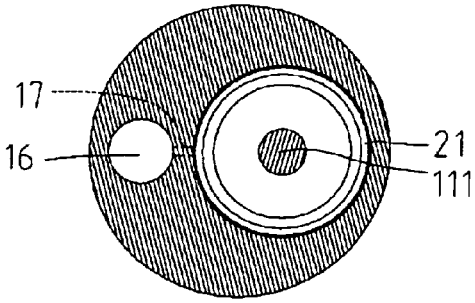
FIG. 10 is a cross-sectional view taken along a line 10—10 in FIG. 9.
Figure 9:
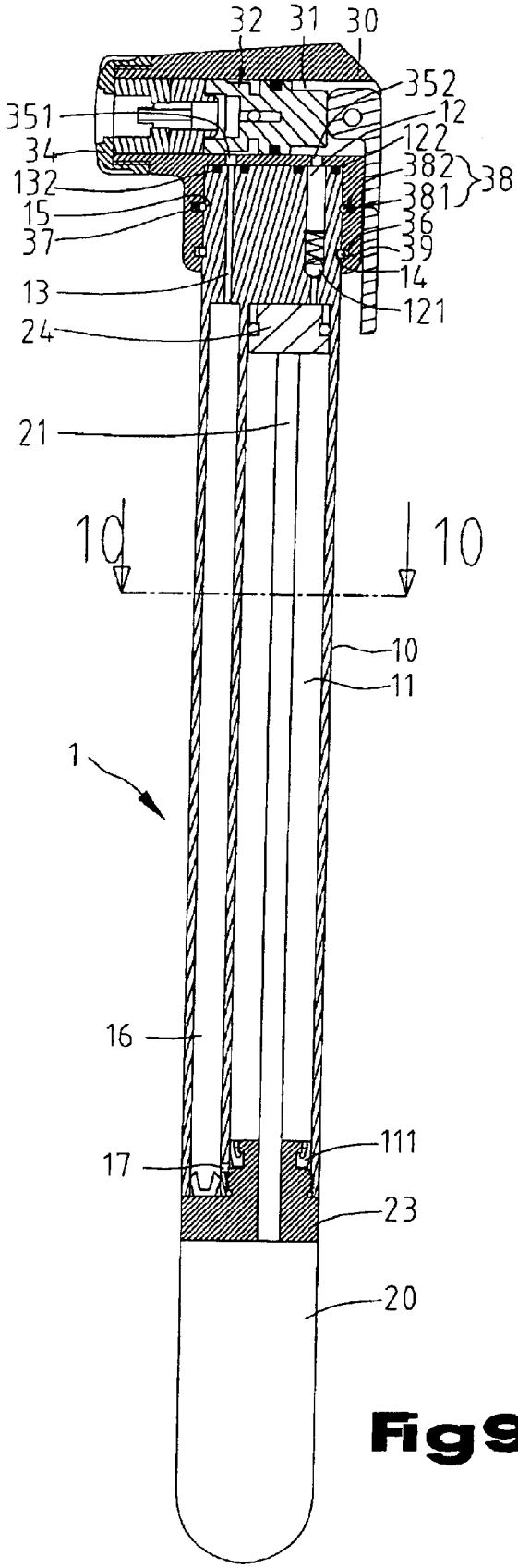
FIG. 9 is a cross-sectional view of a pump for inflating and deflating according to a second embodiment of the present invention.

Referring to FIG. 8, the piston 22 is moved toward the nozzle 30. Air flows from the space 11 into the exterior through the outlet 12, past the check valve 121. Air cannot flow from the space 11 into the ball 40 through the inlet 13 because of the check valve 131.

FIGS. 9~14 show a pump for inflating and deflating according to a second embodiment of the present invention. The second embodiment is identical to the first embodiment except for three points. Firstly, a one-way piston 24 is used instead of the piston 22. The one-way piston 24 divides the space 11 into an upper portion and a lower portion. Secondly, the cylinder 10 defines an additional space 16 communicated with the space 11 through a hole 17. The space 16 is communicated with the inlet 13. Thirdly, a check valve 111 is installed in the space 11 instead of the check valve 131 in the inlet 13.

Figure 11:
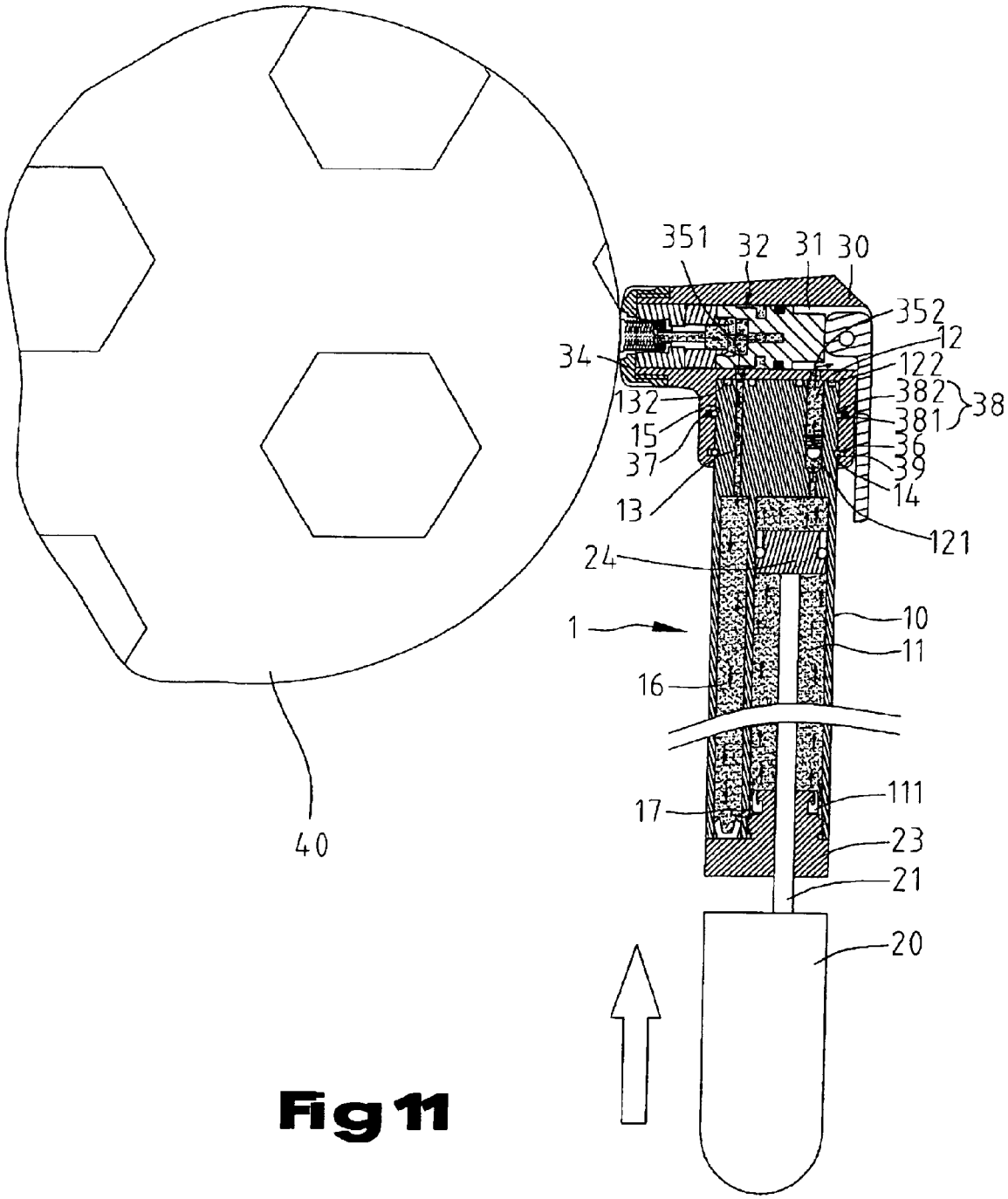
FIG. 11 shows air directed into a cylinder of the pump shown in FIG. 10 from a ball and discharged to the exterior from the cylinder.
Figure 12:
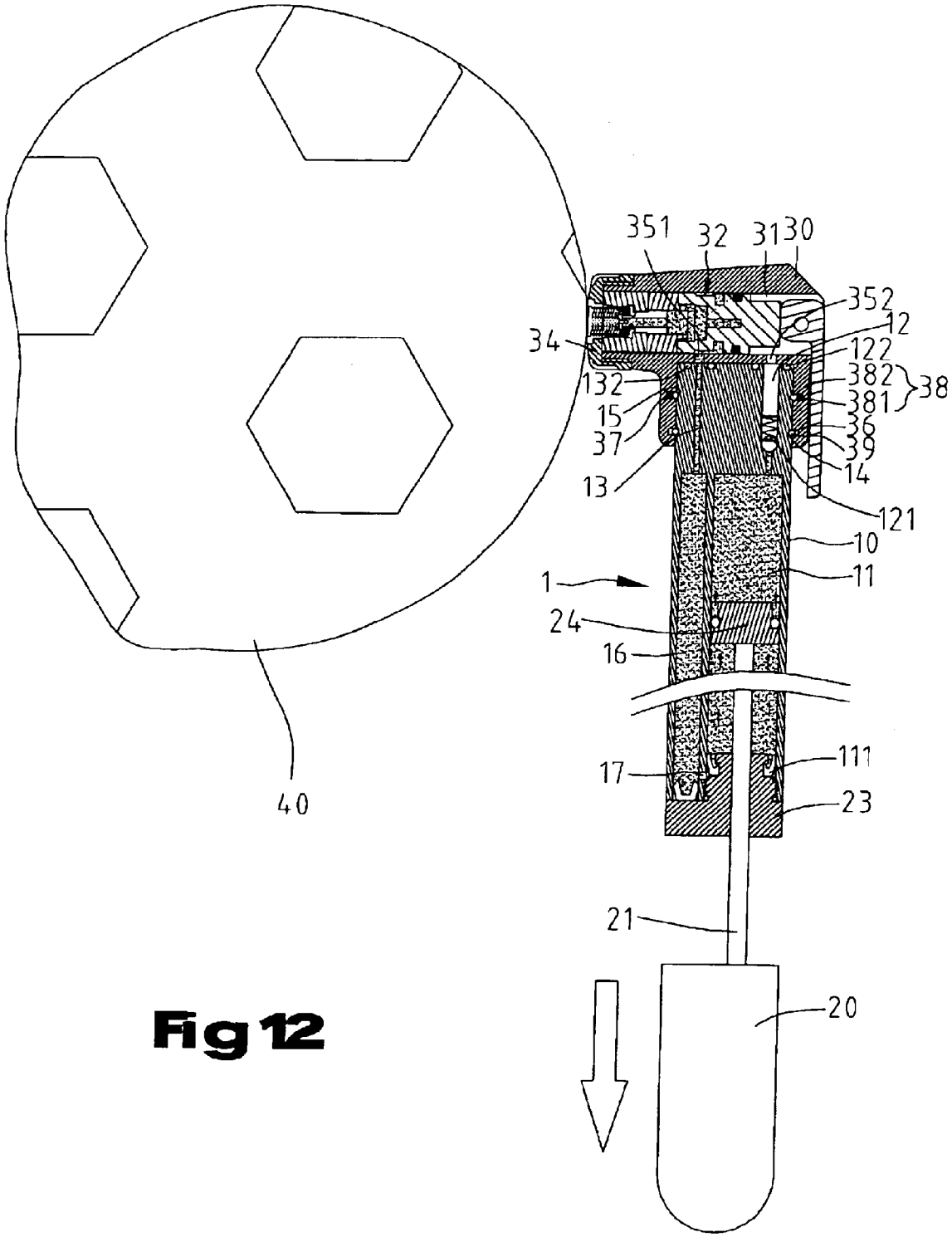
FIG. 12 shows air pumped to a rear side from a front side of a piston in the cylinder shown in FIG. 11.

Referring to FIGS. 11 and 12, the inlet 13 and the space 16 are communicated with the hole 351, and the outlet 12 with the hole 352. Thus, the one-way piston 24 can be reciprocated in the space 11 for deflating the ball 40.

Referring to FIG. 11, as the one-way piston 24 is moved towards the nozzle 30. Air is pushed from the upper portion of the space 11 to the exterior through the outlet 12, past the check valve 121. Meanwhile, some other air is drawn from the ball 40 into the space 16 through the inlet 13 and further from the space 16 into the space 11 through the hole 17, past the check valve 111.

Referring to FIG. 12, as the one-way piston 24 is moved from the nozzle 30, air flows from the lower portion to the upper portion of the space 11, past the one-way piston 24. At this instant, air cannot flow from the space 16 to the lower portion of the space 11 because of the check valve 111.

Figure 13:
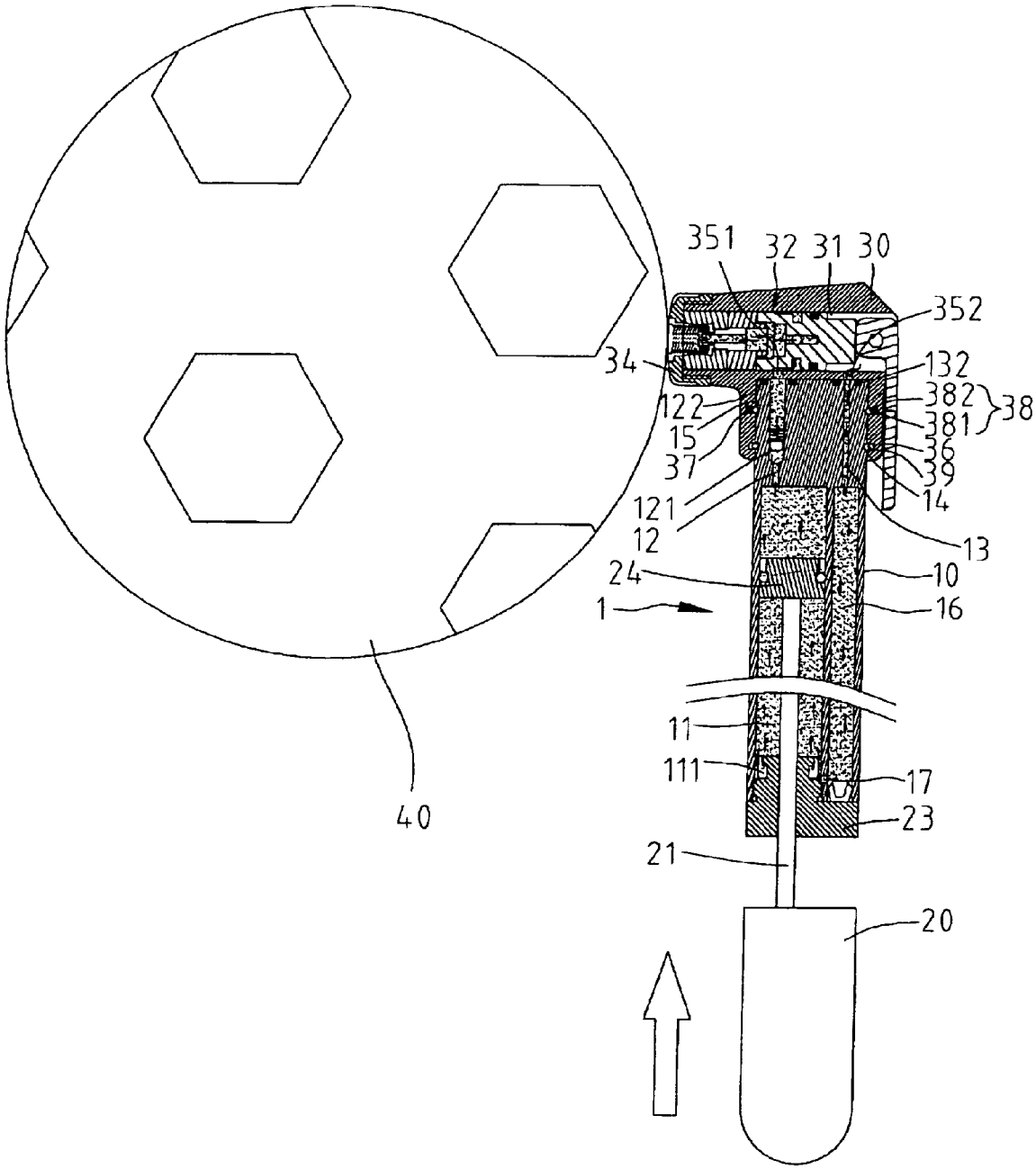
FIG. 13 is similar to FIG. 11, but showing air pumped into the cylinder from the exterior and pumped into the ball from the cylinder.
Figure 14:
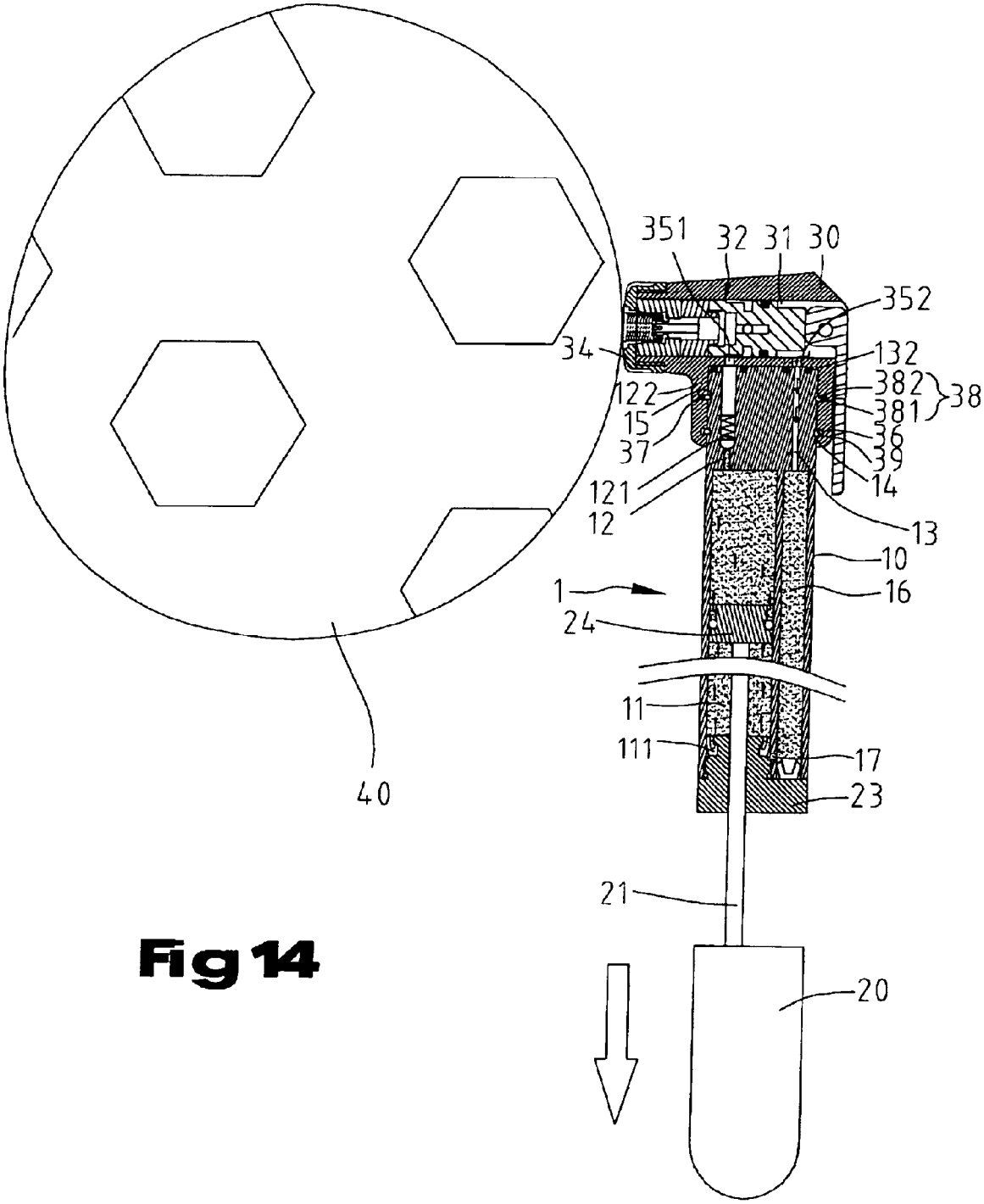
FIG. 14 is similar to FIG. 13, but showing air pumped to the front side from the rear side of the piston.

Referring to FIGS. 13 and 14, the outlet 12 is communicated with the hole 351, and the inlet 13 and the space 16 with the hole 352. Thus, the one-way piston 24 can be reciprocated in the space 11 for inflating the ball 40.

Referring to FIG. 13, as the one-way piston 24 is moved towards the nozzle 30. Air is pushed from the upper portion of the space 11 into the ball 40 through the outlet 12, past the check valve 121. Meanwhile, some other air is drawn from the exterior into the space 16 through the inlet 13 and further from the space 16 into the space 11 through the hole 17, past the check valve 111.

Referring to FIG. 14, as the one-way piston 24 is moved from the nozzle 30, air flows from the lower portion to the upper portion of the space 11, past the one-way piston 24. At this instant, air cannot flow from the space 16 to the lower portion of the space 11 because of the check valve 111.

Figure 16:
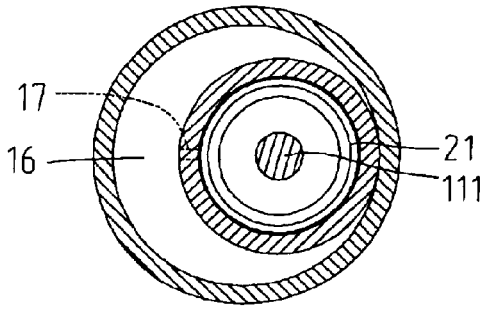
FIG. 16 is a cross-sectional view taken along a line 16—16 in FIG. 15.
Figure 15:
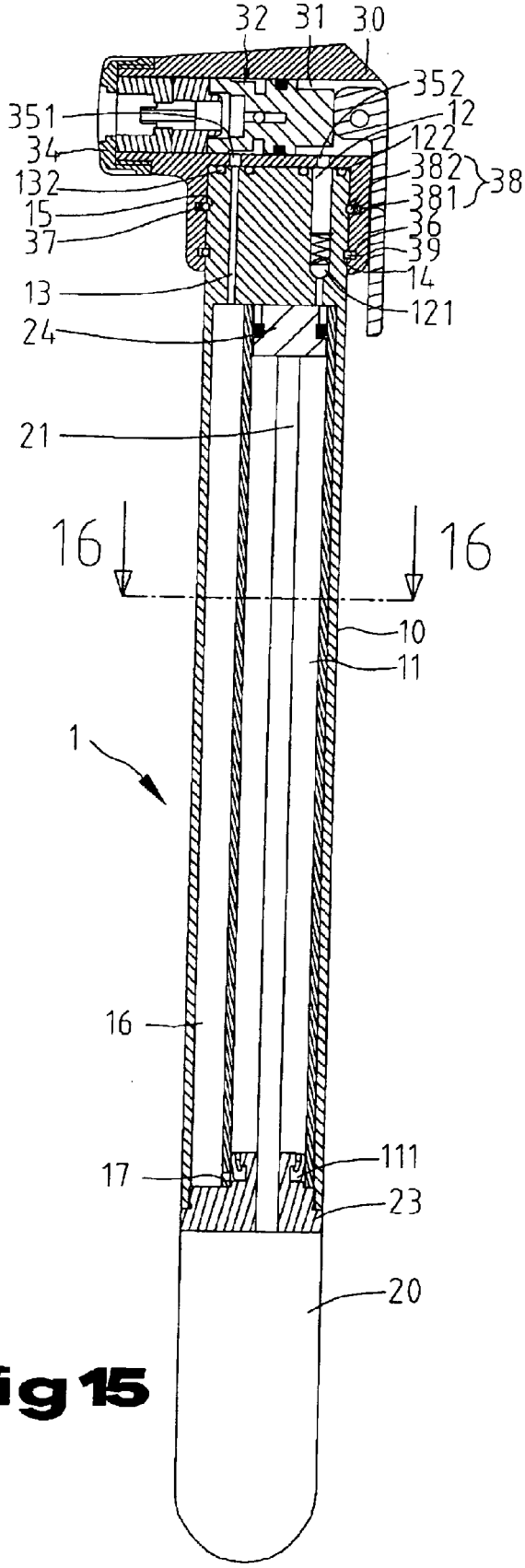
FIG. 15 is a cross-sectional view of a pump for inflating and deflating according to a third embodiment of the present invention.

FIGS. 15 and 16 show a pump for inflating and deflating according to a third embodiment of the present invention.

The third embodiment is identical to the second embodiment except that the space 16 is defined in an additional cylinder 18 inserted in the cylinder 10.

Figure 17:
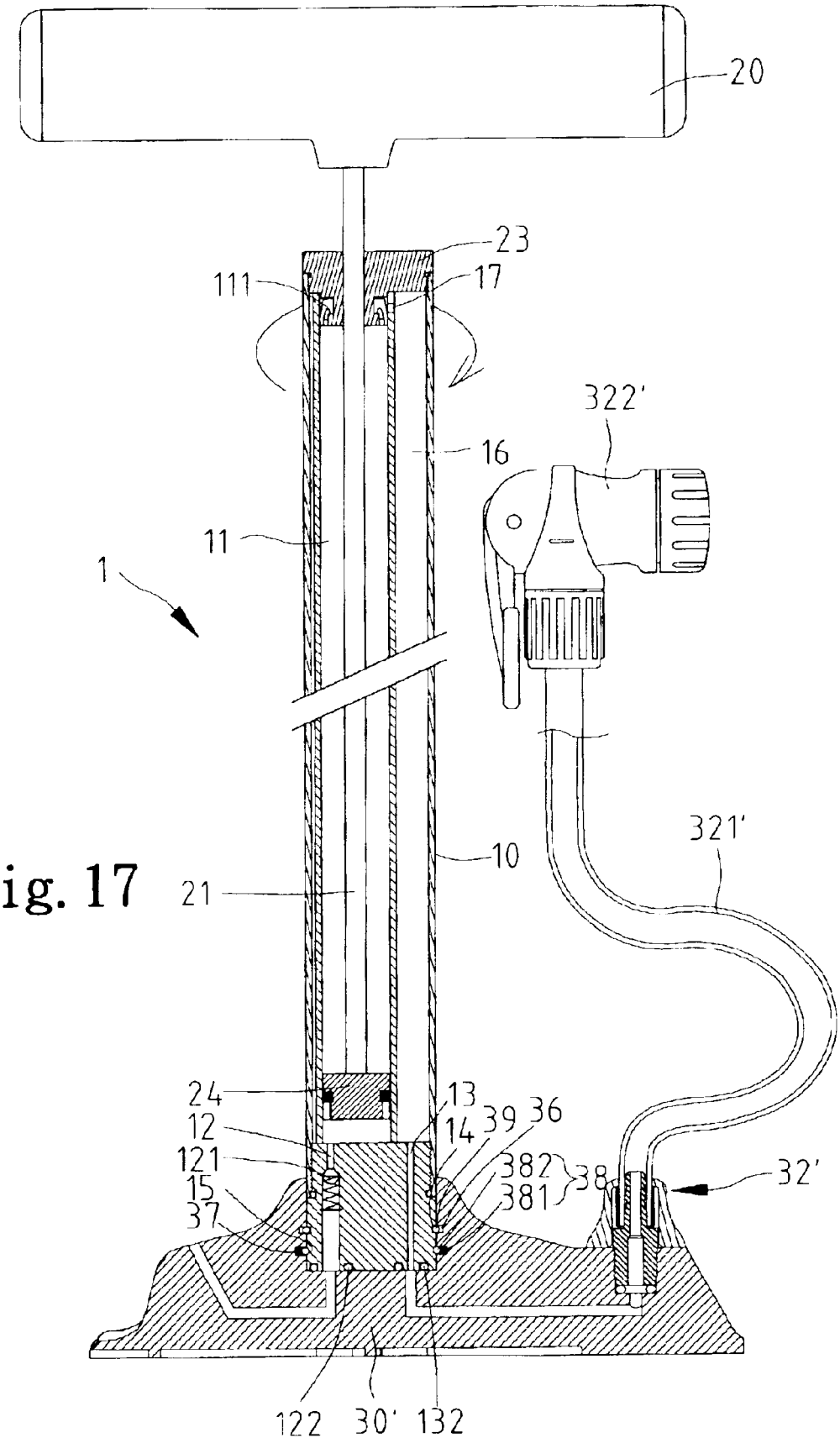
FIG. 17 is a cross-sectional view of a pump for inflating and deflating according to a fourth embodiment of the present invention.
Figure 18:
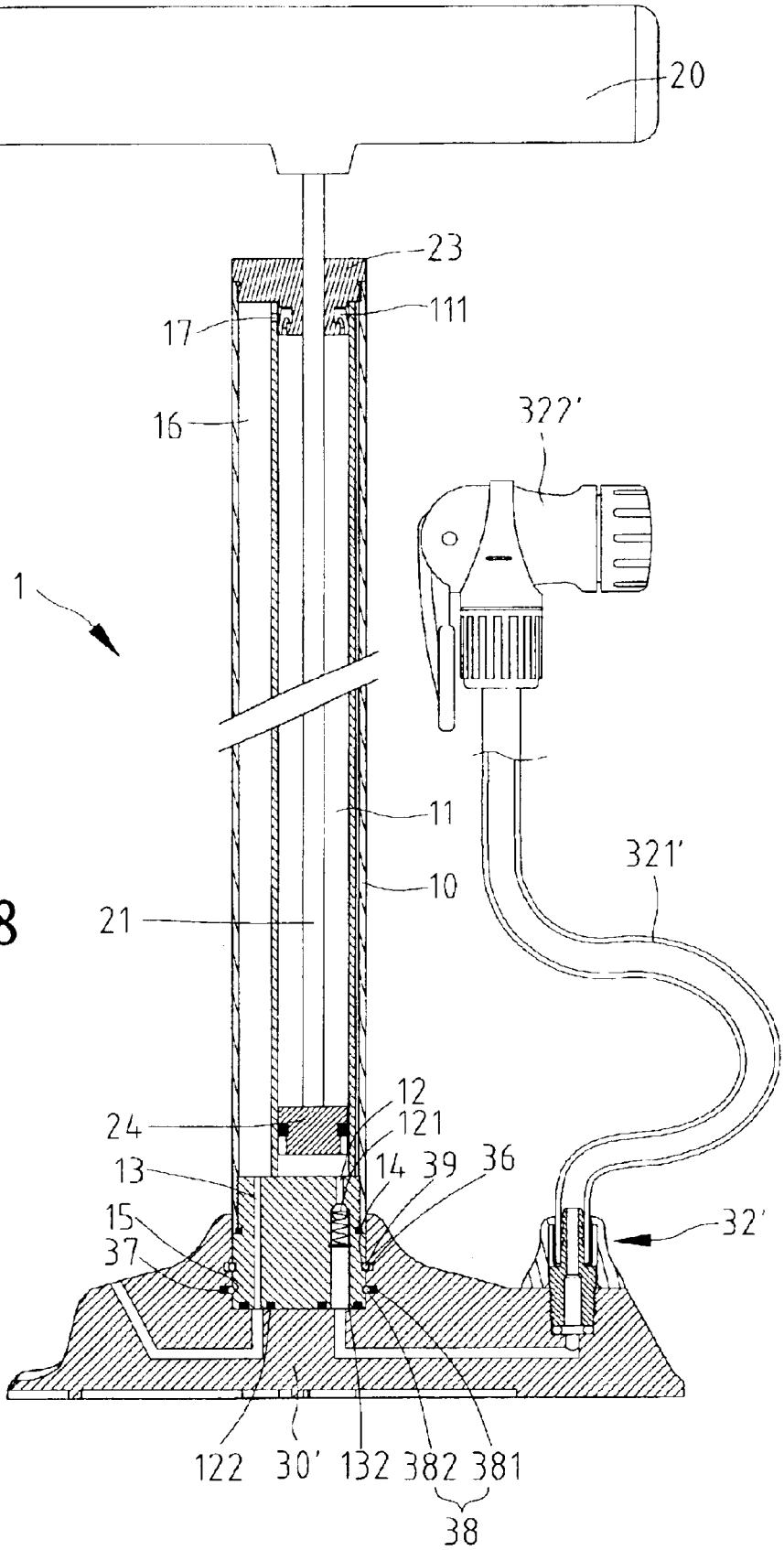
FIG. 18 is similar to FIG. 17, but showing the pump for inflating.

FIGS. 17 and 18 show a pump for inflating and deflating according to a fourth embodiment of the present invention. The fourth embodiment is identical to the third embodiment except for using a base 30' instead of the nozzle 30. The base 30' includes a mouth 32' engaged with a hose 321' leading to a nozzle 322'.

The present invention has been described via detailed illustration of four embodiments. Those skilled in the art can derive variations from the embodiments without departing from the scope of the present invention. Hence, these embodiments shall not limit the scope of the present invention defined in the claims.

What is claimed is:

1. A pump for inflating and deflating an inflatable object, the pump including:

a cylinder defining an inlet through which air can only flow into the cylinder and an outlet through which air can only flow from the cylinder;

a piston reciprocating in the cylinder;

a nozzle defining a first hole for communication with the inflatable object and a second hole for communication with the exterior, the nozzle being mounted on the cylinder for movement between an inflating mode where the first hole is communicated with the outlet and the second hole with the inlet and a deflating mode where the first hole is communicated with the inlet and the second hole with the outlet; and a C-ring with an internal edge put in a groove extending around an external face of the cylinder and an external edge put in a groove extending around an internal face of the nozzle, thus retaining, the nozzle on the cylinder.

2. The pump according to claim 1 further including a check valve installed in the outlet.

3. The pump according to claim 1 further including a check valve installed in the inlet.

4. The pump according to claim 1 further including a seal in a groove extending around the outlet.

5. The pump according to claim 1 further including a seal in a groove extending around the inlet.

6. The pump according to claim 1 further including a retaining device between the cylinder and the nozzle for keeping the cylinder in the inflating and deflating positions relative to the nozzle.

7. The pump according to claim 1 further including a connecting rod with a first end connected with the piston and a second end put outside the cylinder.

8. The pump according to claim 1 wherein the cylinder defines a first space communicated with the outlet and a second space communicated with the inlet and communicated with the first space, wherein the piston is a one-way piston capable of pushing air from the first space to the exterior but not capable of pushing air from the first space to the second space.

9. A pump for inflating and deflating an inflatable object, the pump including:

a cylinder defining an inlet through which air can only flow into the cylinder and an outlet through which air can only flow from the cylinder;

a piston reciprocating in the cylinder;

a nozzle defining a first hole for communication with the inflatable object and a second hole for communication with the exterior, the nozzle being mounted on the cylinder for movement between an inflating mode where the first hole is communicated with the outlet and the second hole with the inlet and a deflating mode where the first hole is communicated with the inlet and the second hole with the outlet; and a spring-biased detent installed on one of the cylinder and the nozzle for insertion in a hole defined in the other one of the cylinder and the nozzle for keeping the cylinder in the inflating and deflating positions relative to the nozzle.

10. The pump according to claim 9 further including a connecting rod with a first end connected with the piston and a second end put outside the cylinder.

11. The pump according to claim 10 further including a handle connected with the second end of the connecting rod.

12. The pump according to claim 10 further including a ring between the cylinder and the connecting rod for keeping the piston in the cylinder.

13. The pump according to claim 12 wherein the ring includes an external face engaged with the internal face of the cylinder, thus retaining the piston in the cylinder.

14. The pump according to claim 9 wherein the cylinder defines a first space communicated with the outlet and a second space communicated with the inlet and communicated with the first space, wherein the piston is a one-way piston capable of pushing air from the first space to the exterior but not capable of pushing air from the first space to the second space.

15. A pump for inflating and deflating an inflatable object, the pump including:

a cylinder defining an inlet through which air can only flow into the cylinder and an outlet through which air can only flow from the cylinder;

a piston reciprocating in the cylinder; and a nozzle defining a first hole for communication with the inflatable object and a second hole for communication with the exterior, the nozzle being mounted on the cylinder for movement between an inflating mode where the first hole is communicated with the outlet and the second hole with the inlet and a deflating mode where the first hole is communicated with the inlet and the second hole with the outlet, wherein the nozzle defines a first chamber for receiving the cylinder and a second chamber for receiving a mouth, and the second chamber is communicated with the first chamber through the first hole and the second, hole.

16. The pump according to claim 15 wherein the mouth divides the second chamber into a first portion communicated with the first hole and a second portion communicated from the second hole.

17. The pump according to claim 15 wherein the cylinder defines a first space communicated with the outlet and a second space communicated with the inlet and communicated with the first space, wherein the piston is a one-way piston capable of pushing air from the first space to the exterior but not capable of pushing air from the first space to the second space.

18. The pump according to claim 17 including a check valve installed in the outlet.

19. The pump according to claim 17 including a check valve installed in the first space.

20. The pump according to claim 17 including a second cylinder inserted in the first cylinder, thus separating the first space from the second space.

* * * * *